US007210405B2

(12) United States Patent
Hessert et al.

(10) Patent No.: US 7,210,405 B2
(45) Date of Patent: May 1, 2007

(54) PRINTER INK SUPPLY SYSTEM WITH VISCOSITY CONTROL

(75) Inventors: Danny R. Hessert, Carol Stream, IL (US); Tracy E. Kucaba, South Elgin, IL (US); Richard H. Schulz, Carol Stream, IL (US)

(73) Assignee: Illinois Tool Works Inc., Glenview, IL (US)

( * ) Notice: Subject to any disclaimer, the term of this patent is extended or adjusted under 35 U.S.C. 154(b) by 330 days.

(21) Appl. No.: 10/774,209

(22) Filed: Feb. 6, 2004

(65) Prior Publication Data

US 2005/0174398 A1 Aug. 11, 2005

(51) Int. Cl.
*B41F 17/00* (2006.01)
*B41F 31/02* (2006.01)

(52) U.S. Cl. ..... 101/163; 101/335; 101/169

(58) Field of Classification Search ..... 101/35, 101/46, 150, 163, 169, 170, 335, 364
See application file for complete search history.

(56) References Cited

U.S. PATENT DOCUMENTS 4,792,292 A * 12/1988 Gaenzle ..... 417/440
5,419,247 A * 5/1995 Bachmann ..... 101/364
5,749,293 A * 5/1998 Ota et al. ..... 101/157
6,129,012 A * 10/2000 Dietz et al. ..... 101/41
2002/0152903 A1* 10/2002 Adner ..... 101/169

* cited by examiner

*Primary Examiner*—Leslie J. Evanisko
(74) *Attorney, Agent, or Firm*—Donald J. Breh; Mark W. Croll; Levenfeld Pearlstein LLC

(57) ABSTRACT

An ink supply system is used with a printer of the type in which ink is deposited in an engraved receiving region on a cliché plate and is scraped from the plate leaving ink in the receiving region. The ink supply system includes an ink cup having a hollow interior defining an ink reservoir and defining an outer edge. The outer edge has a doctor blade formed thereon for engaging and scraping the plate. The ink cup has an inlet and an outlet. A pump has a suction side and a discharge side with the suction side in flow communication with the cup outlet for drawing ink from the cup. A viscosity controller is in flow communication with the pump discharge and receives ink from the pump. A flow conduit extends between the viscosity controller and the ink cup for providing a flow of ink from the viscosity controller to the ink cup. The pump draws ink from the cup to create a negative pressure within the cup and the negative pressure within the cup draws ink from the viscosity controller to the ink cup through the flow conduit.

12 Claims, 1 Drawing Sheet

PRINTER INK SUPPLY SYSTEM WITH VISCOSITY CONTROL

BACKGROUND OF THE INVENTION

The present invention relates to an ink supply system for printers. More particularly, the present invention relates to an ink supply with viscosity control for a printing system.

Automated printing systems are in widespread use in a host of industries. And, the number of types of printing systems is almost as great as the number of industries in which these systems are used.

One type of printing system that operates in a fully automatic or near fully automatic mode is a pad printing system. These systems are used to apply high quality print, e.g. indicia, on flat as well as non-flat surfaces. For example, pad printing systems can be used to print logos and the like on cellular telephone covers, game balls such as golf balls and the like. It will be appreciated that such printing must be carried out, not only on a spherical surface, but on a surface that is formed with dimples as well.

Conventional pad printing systems use a deformable pad which receives ink, transferred as an image, from a flat cliché plate. The plate has an engraving or etching of the indicia formed therein. Ink is transferred from an ink supply to the plate, and fills into the etched areas. The deformable pad is then pressed onto the plate and the ink is picked up by the pad. The image is the transferred to the curved surface which is to be printed. To re-ink the pad, in a commonly used arrangement, an inverted cup containing a quantity of printing ink is used to apply the ink to the cliché plate. To apply a new coating of ink to the cliché plate, the ink cup and cliché plate are moved relative to each other following each ink transfer operation. A doctor blade is fitted to the cup to traverse along the clichéplate and "wipe" the cliché plate. This assures that ink is left behind in the etching but does not build up on the plate, inside or outside of the etched areas.

The ink supply system is configured to maintain a fresh flow or supply of ink to the ink cup so that the ink transferred to the clichéplate is likewise fresh. It is also designed so that the viscosity of the ink is controlled to maintain the flow characteristics within certain desired parameters. The ink flow characteristics are generally maintained to achieve proper ink pick-up (from the plate to the pad) and transfer (from the pad to the object), as well as to achieve good print quality.

In a typical ink supply system, the ink is pumped from a source or supply to the ink cup. As such, the ink entering the cup is under pressure which can adversely effect the seal between the doctor blade and the clichéplate. This can also effect the quantity of ink that is deposited in the etching as well as outside of the etching, as well as the flow characteristics of the supplied ink.

Accordingly, there is a need for an ink supply system for a printing system that provides the ability to maintain control of the flow characteristics of the supplied ink. Desirably, such a system operates without pressurizing the ink cup into which the ink is supplied.

SUMMARY OF THE INVENTION

An ink supply system is configured for use with a printer of the type in which ink is deposited in a receiving region on a plate and excess ink is scraped from the plate leaving ink in the receiving region. The ink supply system includes an ink cup having a hollow interior defining an ink reservoir and defining an outer edge or doctor blade for engaging and scraping the plate.

The ink cup has an inlet and an outlet. A pump has a suction side and a discharge side, with the suction side in flow communication with the cup outlet. As such, the pump draws ink from the cup.

The ink from the cup is pumped to a viscosity controller. A flow conduit, preferably a passive conduit, extends between the viscosity controller and the ink cup and provides a flow path for ink from the viscosity controller to the ink cup. As the pump draws ink from the cup, it creates a negative pressure within the cup. The negative pressure in the ink cup in turn draws ink from the viscosity controller to the cup through the flow conduit.

An ink thinner supply in flow communication with the viscosity controller provides the ability to maintain control of the flow characteristics (e.g., the viscosity) of the supplied ink. A viscosity measuring device is included with or as part of the viscosity controller. Such a system operates without pressurizing the ink cup into which the ink is supplied.

These and other features and advantages of the present invention will be readily apparent from the following detailed description, in conjunction with the claims.

BRIEF DESCRIPTION OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
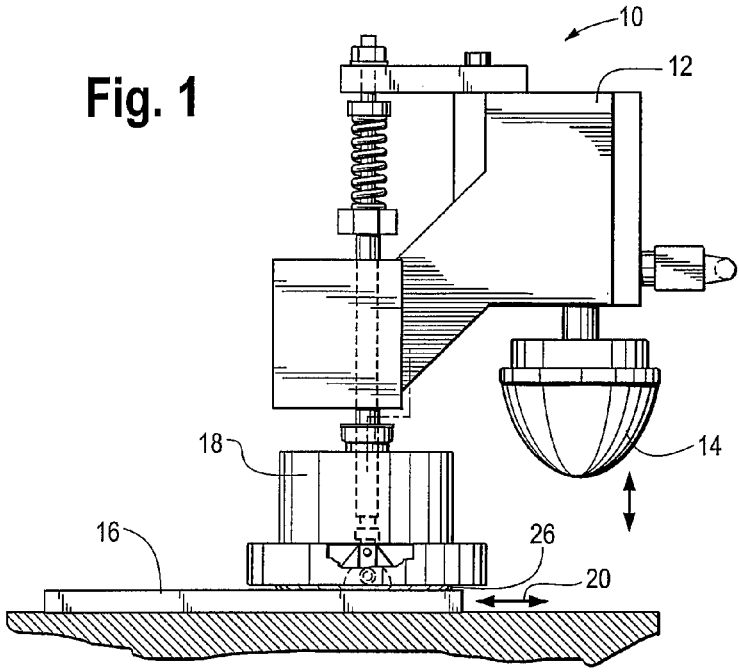
FIG. 1 is a side view of portions of a pad printer illustrating the printing pad, a clichéplate and an ink cup.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be understood that the title of this section of this specification, namely, "Detailed Description Of The Invention", relates to a requirement of the United States Patent Office, and does not imply, nor should be inferred to limit the subject matter disclosed herein.

Referring now to the figures and briefly to FIG. 1, there is shown a portion of an exemplary pad printing system 10. The pad printer 10 includes a frame 12 having a reciprocating printing pad 14 mounted thereto. The printing pad 14 is a deformable pad onto which the ink is transferred, and from which the ink is transferred to the object to be imprinted. A typical pad 14 is formed from a resilient, low permeability material such as silicone rubber or the like.

The printer 10 includes a clichéplate 16 which has the artwork in the form of an engraving etched or engraved therein and an ink cup 18. The plate 16 and cup 18 reciprocate relative to one another (as indicated by the arrow at 20) to supply ink to the plate 16.

Figure 2:
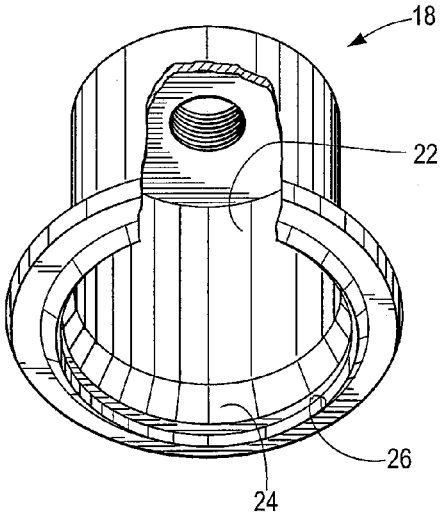
FIG. 2 is a perspective view of an exemplary ink cup.

Referring to FIG. 2, the ink cup 18 includes a reservoir body 22 with an open lower end 24 and a doctor blade or knife ring 26 around the open end 24. The doctor blade 26 is maintained in intimate contact with the clichéplate 16 to form a seal for retaining the ink I in the cup 18. The blade also serves to scrape the cliché16 surface clean of all ink as the cliché16 is advanced from a loading position (shown in FIG. 1) to a transfer position. The only ink retained on the plate 16 is that in the engraved or etched regions in the plate 16 surface that define the print pattern.

It is important that the contact edge surface of the doctor blade 26 and the clichéplate 16 be maintained in suitable compressive engagement with one another throughout the length of the knife blade, i.e. throughout the circumference of the blade ring 26. It has been found that in known ink supply systems, variations in either surface (the doctor blade 26 or the plate 16 surface), even on the order of a few microns, or variations in the compressive force between the blade 26 and the plate 16 surface along different portions of the circumference of the ring, can cause leakage of the ink or leave a film of ink in undesired areas of the exposed portions of the clichéplate. This is due, in part, to the pressurized environment within the ink cup 18.

Figure 3:
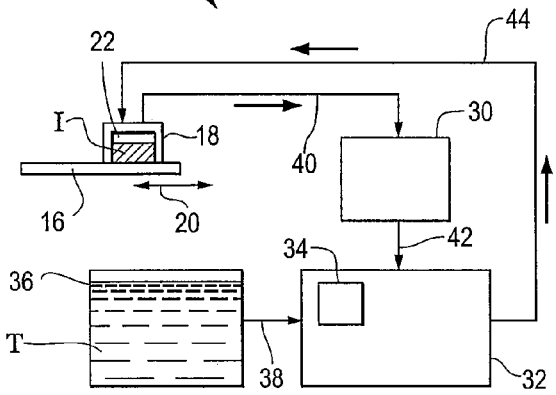
FIG. 3 is a schematic illustration of an ink supply system embodying the principles of the present invention.

The present ink supply system 28 overcomes some of these problems by providing a non-pressurized environment with the ink cup 18. Referring to FIG. 3, there is shown a schematic illustration of the ink supply system 28. The system 28 includes the ink reservoir (the ink cup 18), a pump 30, a viscosity control device 32, including for example a rheometer 34 for measuring ink viscosity, and an ink diluent or thinner T supply 36.

Unlike known systems in which the ink I is pumped into the cup under pressure, the present system 28 includes a pump 30 that takes suction from the cup 18 and pumps into the viscosity controller 32. A supply line 38 routes thinner T to the controller 32, as needed, to provide ink I at the desired flow characteristics (viscosity). The ink I is thus pumped into the controller 32, rather than into the cup 18. Flow is provided between the cup 18 and the pump 30, between the pump 30 and the controller 32 and between the controller 32 and the cup 18 by lines 40, 42 and 44, respectively.

The present ink supply system 28 thus places the ink cup 18 in a lower pressure environment than known ink supplies. To this end, as the ink I is drawn out of the cup 18 by the pump 30 through suction line 40, the pressure in the ink cup 18 decreases. This decrease in pressure in the ink cup 18 provides the driving force to "pull" ink I from the viscosity controller 32 through cup supply line 44.

As will be understood, the decreased pressure in the ink cup 18 creates a vacuum condition within the cup 18 (as sealed by the clichéplate 16). Thus, there is no outward leakage of ink, and the conditions under which undesired ink is left on the plate 16 (such as a pressurized cup 18 in conjunction with variations in either the plate 16 surface or doctor blade 26 edge) are lessened or eliminated.

In a present ink supply system 28, the cup 18 is maintained at a pressure of less than about 1 atmosphere (1 atm.) and the cup supply line 44 operates at a pressure of about 1 atm. The controller 32 is maintained at an elevation below that of the cup 18, or within an environment in which the static head in the controller 32 is less than the static head in the cup 18. This reduces the opportunity to over-pressurize the ink cup 18.

All patents referred to herein, are incorporated herein by reference, whether or not specifically done so within the text of this disclosure.

In the disclosure, the words "a" or "an" are to be taken to include both the singular and the plural. Conversely, any reference to plural items shall, where appropriate, include the singular.

From the foregoing it will be observed that numerous modification and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. An ink supply system for use with a printer of the type in which ink is deposited in a receiving region on a plate and ink is scraped from the plate leaving ink in the receiving region, comprising:

an ink cup having a hollow interior defining an ink reservoir and defining an outer edge, the outer edge having a scraping element thereon for engaging the plate, the ink cup having an inlet and an outlet;

a pump having a suction side and a discharge side, the suction side being in flow communication with the ink cup outlet for drawing ink from the cup;

a viscosity controller in flow communication with the pump discharge side and configured to receive ink from the pump;

a flow conduit extending between the viscosity controller and the ink cup for providing a flow of ink from the viscosity controller to the ink cup, wherein the ink cup is at an elevation and wherein the viscosity controller is at an elevation that is lower than the elevation of the ink cup, and wherein the pump draws ink from the cup creating a negative pressure less than atmospheric pressure within the cup and wherein the negative pressure less than atmospheric pressure within the cup draws ink from the viscosity controller to the ink cup through the flow conduit.

2. The ink supply system in accordance with claim 1 including an ink thinner supply, the ink thinner supply being in flow communication with the viscosity controller.

3. The ink supply system in accordance with claim 2 wherein when the viscosity controller senses a higher than desired viscosity of the ink, a quantity of the ink thinner is provided to the viscosity controller to mix with the ink to reduce the ink viscosity.

4. The ink supply system in accordance with claim 1 wherein the flow conduit extending between the viscosity controller and the ink cup is a passive flow conduit.

5. The ink supply system in accordance with claim 1 wherein the scraping element is a doctor blade.

6. The ink supply system in accordance with claim 1 wherein the viscosity controller includes a viscosity measuring device.

7. An ink supply system for use with a printer of the type in which ink is deposited in a receiving region on a plate and ink is scraped from the plate leaving ink in the receiving region, comprising:

an ink cup having a hollow interior defining an ink reservoir and defining an outer edge, the outer edge having a scraping element thereon for engaging the plate, the ink cup having an inlet and an outlet;

a viscosity controller in flow communication with the ink cup, the viscosity controller being at an elevation no higher than the ink cup;

a first flow conduit extending between the viscosity controller and the ink cup inlet for providing a flow of ink from the viscosity controller to the ink cup;

a second flow conduit extending between the viscosity controller and the ink cup outlet for providing a flow of ink from the ink cup to the viscosity controller; and means for creating a negative pressure, less than atmospheric pressure in the ink cup disposed in the second flow conduit.

8. The ink supply system in accordance with claim 7 including an ink thinner supply in flow communication with the viscosity controller, and wherein when the viscosity controller senses a higher than desired viscosity of the ink, a quantity of ink thinner is provided to the viscosity controller to mix with the ink to thin the ink.

9. The ink supply system in accordance with claim 7 wherein the viscosity controller includes a viscosity measuring device.

10. The ink supply system in accordance with claim 7 wherein the first flow conduit is a passive flow conduit.

11. The ink supply system in accordance with claim 7 wherein the scraping element is a doctor blade.

12. The ink supply system in accordance with claim 7 wherein the means for creating a less than atmospheric pressure is a pump disposed between the ink cup and the viscosity controller and wherein the pump takes suction from the ink cup.

* * * * *